United States Patent [19]

Onda et al.

[11] Patent Number: 4,498,965

[45] Date of Patent: Feb. 12, 1985

[54] PLATING APPARATUS

[75] Inventors: Tsutomu Onda, Nishio; Keiichi Kano, Nagoya; Shinji Itakura, Hekinan, all of Japan

[73] Assignee: Aisin Seiki Kabushiki Kaisha, Kariya, Japan

[21] Appl. No.: 312,355

[22] Filed: Oct. 16, 1981

[30] Foreign Application Priority Data

Oct. 16, 1980 [JP] Japan ..... 55-144890

[51] Int. Cl.[3] ..... C25D 7/04; C25D 7/02; C25D 3/12

[52] U.S. Cl. ..... 204/228; 204/23; 204/297 R; 204/225

[58] Field of Search ..... 204/26, 224 M, 225, 204/DIG. 7, 297 R, 23, 272

[56] References Cited

U.S. PATENT DOCUMENTS

| | | | |
|---|---|---|---|
| 3,464,910 | 9/1969 | Krebs et al. | 204/272 |
| 3,751,346 | 8/1973 | Ellis et al. | 204/224 M |
| 3,891,515 | 6/1975 | Paulson et al. | 204/DIG. 7 |
| 4,096,042 | 9/1978 | Looney et al. | 204/26 |
| 4,246,088 | 1/1981 | Murphy et al. | 204/275 |

*Primary Examiner*—Brian E. Hearn

*Assistant Examiner*—Nathan Thane

*Attorney, Agent, or Firm*—Oblon, Fisher, Spivak, McClelland & Maier

[57] ABSTRACT

A plating apparatus for plating an annular diaphragm member which includes a first lower member including a first vertical passage formed therein having an opening, an outlet port in fluid communication with the first vertical passage, and a surface formed around the upper opening for mounting the annular member thereon, a second, upper member detachably mounted on the first member so as to form a casing, the second member including a second vertical passage formed therein having a lower opening opposed to the upper opening, and an inlet port in fluid communication with the second vertical passage, the lower opening having a larger radius than that of the upper opening, a positive electrode positioned above an upper inner peripheral portion of the annular member, a mechanism for supplying plating fluid under pressure to the inlet port, a control mechanism for controlling current distribution from the positive electrode to the upper inner peripheral portion of the annular member and a negative electrode electrically connected to the annular member wherein plating fluid is supplied to the inlet port under pressure and is discharged from the outlet port.

8 Claims, 3 Drawing Figures

PLATING APPARATUS

BACKGROUND OF THE INVENTION

1. Field of the Invention

This invention relates to a plating apparatus.

2. Description of the Prior Art

Various apparatuses for plating have been previously utilized. However, it has been found that an inner peripheral portion of an annular member cannot be plated with uniform thickness at high speed by such conventional apparatuses.

SUMMARY OF THE INVENTION

Therefore, one of the objects of the present invention is to provide an apparatus for plating an inner peripheral portion of an annular member with uniform thickness at high speed.

In accordance with the present invention, a plating apparatus is provided for plating an annular member which includes a first lower member including a first vertical passage formed therein having an upper opening, an outlet port in fluid communication with the first vertical passage, and a surface formed around the upper opening for mounting the annular member thereon, a second, upper member detachably mounted on the first member so as to form a casing, the second member including a second vertical passage formed therein having a lower opening opposed to the upper opening, and an inlet port in fluid communication with the second vertical passage, the lower opening having a larger radius than that of the upper opening, a positive electrode positioned above an upper inner peripheral portion of the annular member, a mechanism for supplying plating fluid under pressure to the inlet port, a control mechanism for controlling current distribution from the positive electrode to the upper inner peripheral portion of the annular member and a negative electrode electrically connected to the annular member wherein plating fluid is supplied to the inlet port under pressure and is discharged from the outlet port.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENTS

Figure 1:
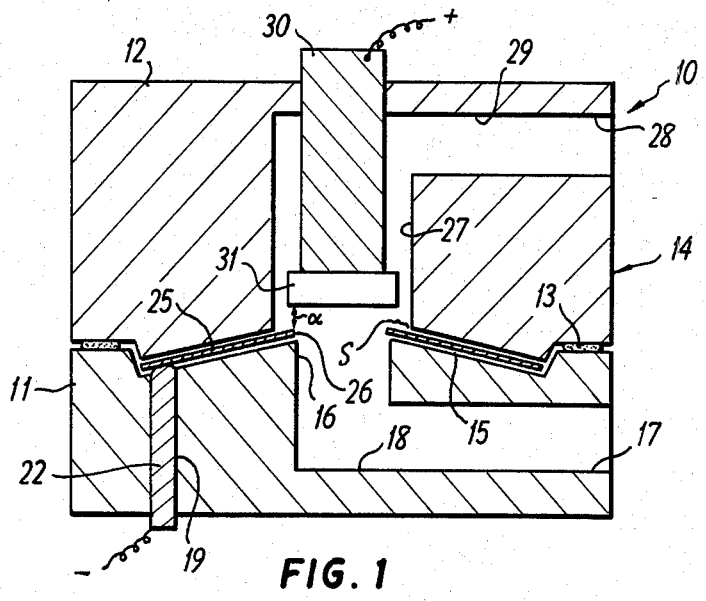
FIG. 1 is a sectional view of an apparatus for plating according to the present invention.
Figure 2:
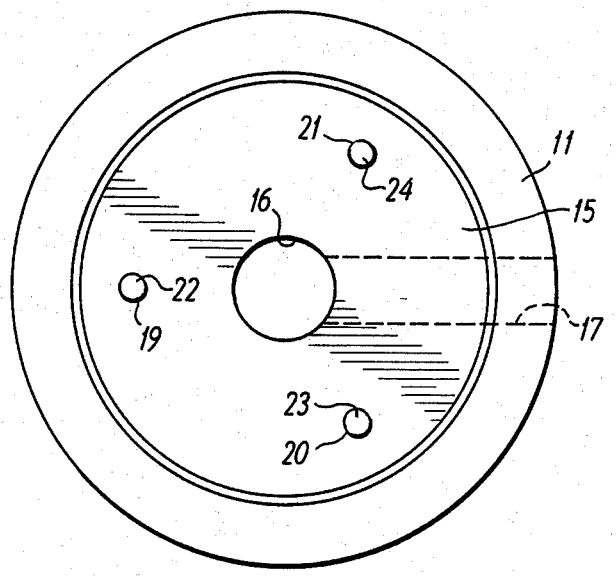
FIG. 2 is a plan view of a lower member of the apparatus shown in FIG. 1.

Referring now to FIGS. 1 and 2, a plating apparatus 10 has a casing 14 including an upper member 12 and a lower member 11. Upper member 12 is detachably connected to lower member 11 such that a fluid-tight seal therebetween is assured by a sealing member 13.

Lower member 11 is provided with a vertical passage 16 and a horizontal passage 18 communicating with vertical passage 16. Horizontal passage 18 is perpendicular to vertical passage 16 and is in fluid communication with an outlet port 17 formed in lower member 11.

Around an upper opening of the vertical passage 16, is formed a conical surface 15 having a gradual slope so as to mount an annular diaphragm or annular disk shaped member 25 thereon to be plated. Lower member 11 includes three vertical holes 19,20 and 21 formed therein with equal pitch. Holes 19, 20 and 21 have inserted therein three negative electrodes 22, 23 and 24, respectively. Each of the upper ends of the negative electrodes 22, 23 and 24 slightly project from conical surface 15 so as to support an annular member 25. Electrodes 22, 23 and 24 are electrically connected to a negative terminal of a power supply (not shown) and a central hole 26 of annular member 25 is colinear with vertical passage 16 of lower member 11.

Upper member 12 has formed therein a vertical passage 27 having a larger radius than that of vertical passage 16 of lower member 11 and which defines an area S to be plated on annular member 25. A horizontal passage 29 in upper member 12 is perpendicular to vertical passage 27 and is in fluid communication with an inlet port 28.

Vertical passage 27 has inserted therein a positive electrode 30 electrically connected to a positive terminal of the power supply. A control member 31 made of a non-conductive material such as a hard vinyl chloride resin is secured to a lower end portion of positive electrode 30 so as to oppose an upper inner peripheral portion of annular member 25. Positive electrode 30 is movable in the vertical direction, thereby controlling current distribution on the upper inner peripheral portion of annular member 25. Plating fluid is continually supplied to inlet port 28 and is circulated thereto through passage 27, passage 16, passage 18 and outlet port 17.

In FIG. 1, $\alpha$ denotes the length between control member 31 and annular member 25. After a chrominum plating experiment was conducted so as to confirm the effect of the apparatus according to the present invention, the upper inner periphery of annular member 25 obtained a $22\mu$ thickness with a 10.5 mm circular width. The conditions of the experiment were as follows:

| | | |
|---|---|---|
| annular member (diaphragm) | outer radius | 180 mm |
| | inner radius | 43 mm |
| | thickness | 2 mm |
| formation of plating fluid | chronic anhydride | 200 g/l |
| | sulfaric acid | 1.5 g/l |
| | soda silicafluoride | 5 g/l |
| temperature of the plating fluid | 77° C. | |
| diameter of the central member | 53 mm | |
| $\alpha$ | 10.5 mm | |
| supplying speed of the plating fluid under pressure | 1.8 m/sec | |
| current density | 400 A/dm$^2$ | |

Figure 3:
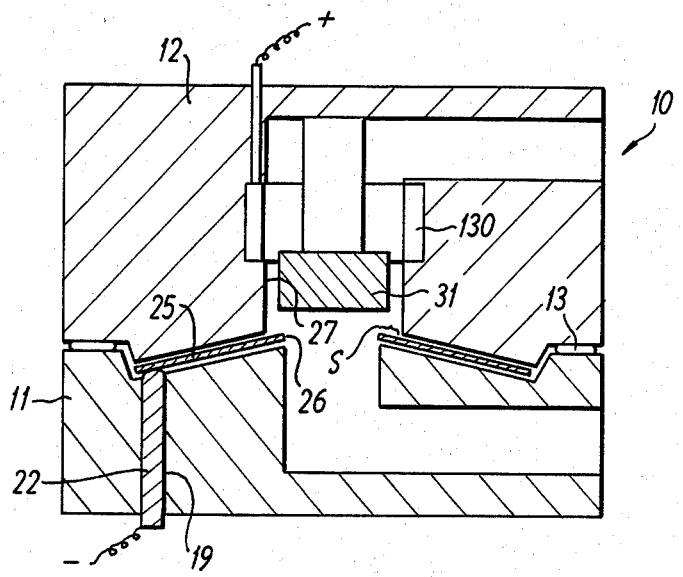
FIG. 3 is a sectional view of the second embodiment of the present invention.

As seen from FIG. 3, a cyclindrical positive electrode 130 may be positioned in an inner wall portion of passage 27. Further, in order to control current distribution on the upper inner peripheral portion of annular member 25, it is possible to vary the diameter of control member 31 and to vary the value of $\alpha$.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A plating apparatus for plating an inner peripheral portion of an annular diaphragm member, comprising:

a lower member including a first vertical passage formed therein having an upper opening, an outlet port in fluid communication with said first vertical passage, and a surface formed around said upper opening for mounting said annular diaphragm member thereon;

an upper member detachably mounted on said lower member so as to form a casing within which said annular diaphragm member is to be positioned, said upper member including a second vertical passage formed therein having a lower opening opposed to said upper opening, and an inlet port in fluid communication with said second vertical passage, said lower opening having a larger radius than that of said upper opening so as to define an area to be plated on said annular diaphragm member;

positive electrode means positioned above an upper inner peripheral portion of said annular diaphragm member;

means for supplying plating fluid under pressure to said inlet port;

control means for controlling current distribution from said positive electrode means to said upper inner peripheral portion of said annular diaphragm member;

negative electrode means electrically connected to said annular diaphragm member wherein plating fluid supplied to said inlet port under pressure is fed to and discharged from said outlet port and wherein said control means is made of non-conductive material and is positioned between said positive electrode means and said annular diaphragm member in said vertical passage; and means for moving said control means in a vertical direction of said second vertical passage so as to control current distribution on an upper peripheral portion of said annular diaphragm member.

2. A plating apparatus in accordance with claim 1, wherein said negative electrode means further comprises at least three bar-shaped electrodes slightly projecting from said surface upon which said annular diaphragm member is mounted.

3. A plating apparatus in accordance with claim 2, wherein said electrodes further comprise equally pitched electrodes.

4. A plating apparatus in accordance with claim 1, wherein said positive electrode means further comprises a cylindrical shaped electrode positioned in an inner wall portion of said second vertical passage.

5. A plating apparatus in accordance with claim 1, further comprising means for securing said control means to a lower portion of said positive electrode means.

6. A plating apparatus in accordance with claim 1, wherein said annular diaphragm member further comprises a disk shaped annular diaphragm member.

7. A plating apparatus for plating an inner peripheral portion of an annular diaphragm member:

a lower member including a first vertical passage formed therein having an upper opening, an outlet port in fluid communication with said first vertical passage, and a surface formed around said upper opening for mounting said annular diaphragm member thereon;

an upper member detachably mounted on said lower member so as to form a casing within which said annular diaphragm member is positioned, said upper member including a second vertical passage formed therein having a lower opening opposed to said upper opening, and an inlet port in fluid communication with said second vertical passage, said lower opening having a larger radius than that of said upper opening so as to define an area to be plated on said annular diaphragm member;

positive electrode means positioned above an upper inner peripheral portion of said annular diaphragm member;

means for supplying plating fluid under pressure to said inlet port;

control means for controlling current distribution from said positive electrode means to said upper inner peripheral portion of said annular diaphragm member;

negative electrode means electrically connected to said annular diaphragm member wherein plating fluid supplied to said inlet port under pressure is fed to and discharged from said outlet port, said surface further comprises a conical surface, and wherein said control means is made of non-conductive material and is positioned between said positive electrode means and said annular diaphragm member in said vertical passage; and means for moving said control means in a vertical direction of said second vertical passage so as to control current distribution on an upper peripheral portion of said annular diaphragm member.

8. A plating apparatus in accordance with claim 7, wherein said conical surface further comprises a gradually sloped conical surface.

* * * * *